US007545333B2

(12) United States Patent
Li et al.

(10) Patent No.: US 7,545,333 B2
(45) Date of Patent: Jun. 9, 2009

(54) MULTIPLE-LAYER PATCH ANTENNA

(75) Inventors: Qian Li, Ann Arbor, MI (US); Wladimiro Villarroel, Worthington, OH (US)

(73) Assignee: AGC Automotive Americas R&D, Ypsilanti, MI (US)

( * ) Notice: Subject to any disclaimer, the term of this patent is extended or adjusted under 35 U.S.C. 154(b) by 396 days.

(21) Appl. No.: 11/377,752

(22) Filed: Mar. 16, 2006

(65) Prior Publication Data

US 2007/0216589 A1 Sep. 20, 2007

(51) Int. Cl.
*H01Q 1/32* (2006.01)

(52) U.S. Cl. ..... 343/713

(58) Field of Classification Search ..... 343/711–713
See application file for complete search history.

(56) References Cited

U.S. PATENT DOCUMENTS 2,547,414 A * 4/1951 Sichak ..... 343/786
3,995,277 A * 11/1976 Olyphant, Jr. ..... 343/846
4,089,003 A 5/1978 Conroy
4,903,033 A 2/1990 Tsao et al.
4,907,011 A * 3/1990 Kuo ..... 343/792.5
4,914,445 A 4/1990 Shoemaker
4,929,959 A 5/1990 Sorbello et al.
5,121,127 A 6/1992 Toriyama
5,270,722 A 12/1993 Delestre
5,519,406 A * 5/1996 Tsukamoto et al. ... 343/700 MS
5,568,159 A 10/1996 Pelton et al.
5,596,336 A 1/1997 Liu
5,621,420 A * 4/1997 Benson ..... 343/791
5,633,645 A 5/1997 Day
5,898,405 A 4/1999 Iwasaki
5,945,950 A 8/1999 Elbadawy
5,949,383 A * 9/1999 Hayes et al. ..... 343/795
6,114,997 A 9/2000 Lee et al.
6,118,406 A 9/2000 Josypenko
6,191,750 B1 2/2001 Bonebright
6,259,407 B1 7/2001 Tran
6,456,241 B1 * 9/2002 Rothe et al. ..... 343/700 MS (Continued)

FOREIGN PATENT DOCUMENTS

JP 04-122107 4/1992

(Continued)

OTHER PUBLICATIONS

English translation of JP 2003-017931, Japanese Patent Office.

(Continued)

*Primary Examiner*—Huedung Mancuso
(74) *Attorney, Agent, or Firm*—Howard & Howard Attorneys PLLC

(57) ABSTRACT

A patch antenna for receiving and/or transmitting circularly polarized RF signals includes a first radiating layer and a second radiating layer disposed substantially parallel to each other. Each radiating layer defines a pair of perturbation features. A ground plane layer is disposed underneath the radiating layers. The antenna also includes a feed line layer implemented as a coplanar wave guide and disposed between the radiating layers. The feed line layer allows for connection of a single transmission line to the antenna and for electromagnetically connecting the radiating layers to the transmission line. Dielectric layers separate the radiating layers, feed line layer, and ground plane layer.

30 Claims, 4 Drawing Sheets

U.S. PATENT DOCUMENTS

| | | | | |
|---|---|---|---|---|
| 6,825,803 | B2 | 11/2004 | Wixforth et al. | |
| 7,221,321 | B2 * | 5/2007 | Reuss | 343/700 MS |
| 2001/0050638 | A1 | 12/2001 | Ishitobi et al. | |
| 2005/0259030 | A1 | 11/2005 | Mizuno et al. | |
| 2006/0044189 | A1 * | 3/2006 | Livingston et al. | 343/700 MS |
| 2006/0202898 | A1 * | 9/2006 | Li et al. | 343/713 |
| 2006/0258315 | A1 * | 11/2006 | Fein et al. | 455/295 |
| 2007/0024511 | A1 * | 2/2007 | Li et al. | 343/713 |

FOREIGN PATENT DOCUMENTS

| | | |
|---|---|---|
| JP | 09-219618 | 8/1997 |
| JP | 11-068448 | 3/1999 |
| JP | 2003-017931 | 1/2003 |

OTHER PUBLICATIONS

English translation of JP 09-219618, Japanese Patent Office.
English abstract of JP 04-122107, Japanese Patent Office.
English Translation of 11-068448, Japanese Patent Office.

* cited by examiner

MULTIPLE-LAYER PATCH ANTENNA

BACKGROUND OF THE INVENTION

1. Field of the Invention

The subject invention relates to an antenna, specifically a microstrip patch antenna, for receiving and/or transmitting a circularly polarized radio frequency (RF) signal.

2. Description of the Related Art

Patch antennas for receiving circularly polarized RF signals are well known in the art. One example of such an antenna is disclosed in U.S. Pat. No. 5,270,722 (the '722 patent) to Delestre. The '722 patent discloses an antenna including a first radiating layer and a second radiating layer disposed substantially parallel to and apart from each other. Each radiating layer is almost square in shape but two opposite sides are slightly concave (with the other two opposite sides being straight). The second radiating layer is rotated 90° with respect to the first radiating layer such that the concave sides of the second radiating layer align with the straight sides of the first radiating layer, and vice versa. A first transmission line is connected to a center of one of the straight sides of the first radiating layer and a second transmission line is connected to a center of one of the straight sides of the second radiating layer. Because two sides of the second radiating layer are concave, the first transmission line may approach the first radiating layer perpendicularly without coming into contact with the second radiating layer.

Although the antenna of the '722 patent can receive and/or transmit circularly polarized RF signals, the antenna requires a pair of transmission lines to feed the antenna. There remains an opportunity for a patch antenna having two radiating layers which requires only one transmission line.

SUMMARY OF THE INVENTION AND ADVANTAGES

The subject invention provides an antenna including a first radiating layer defining at least one perturbation feature. A second radiating layer is disposed substantially parallel to and apart from the first radiating layer. The second radiating layer defines at least one perturbation feature. The antenna further includes a feed line layer disposed substantially parallel to the radiating layers, apart from the radiating layers, and between the radiating layers. The feed line layer allows for connection of a single transmission line to the antenna and for electromagnetically connecting the radiating layers to the transmission line.

The antenna of the subject invention allows transmission of RF signals to a receiver and/or from a transmitter with only the single transmission line. This single transmission line implementation provides cost savings and a reduction in complexity over prior art antennas. Obviously, this advantage will provide greater use of circular-polarized antennas having a pair of radiating layers to receive RF signals from satellites.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, an antenna is shown generally at 10. In the preferred embodiment, the antenna 10 is utilized to receive a circularly polarized radio frequency (RF) signal from a satellite. Those skilled in the art realize that the antenna 10 may also be used to transmit the circularly polarized RF signal. Specifically, the preferred embodiment of the antenna 10 receives a left-hand circularly polarized (LHCP) RF signal like those produced by a Satellite Digital Audio Radio Service (SDARS) provider, such as XM® Satellite Radio or SIRIUS® Satellite Radio. However, it is to be understood that the antenna 10 may also receive a right-hand circularly polarized (RHCP) RF signal. Furthermore, the antenna 10 may also be utilized to transmit or receive a linearly polarized RF signal.

Figure 1:
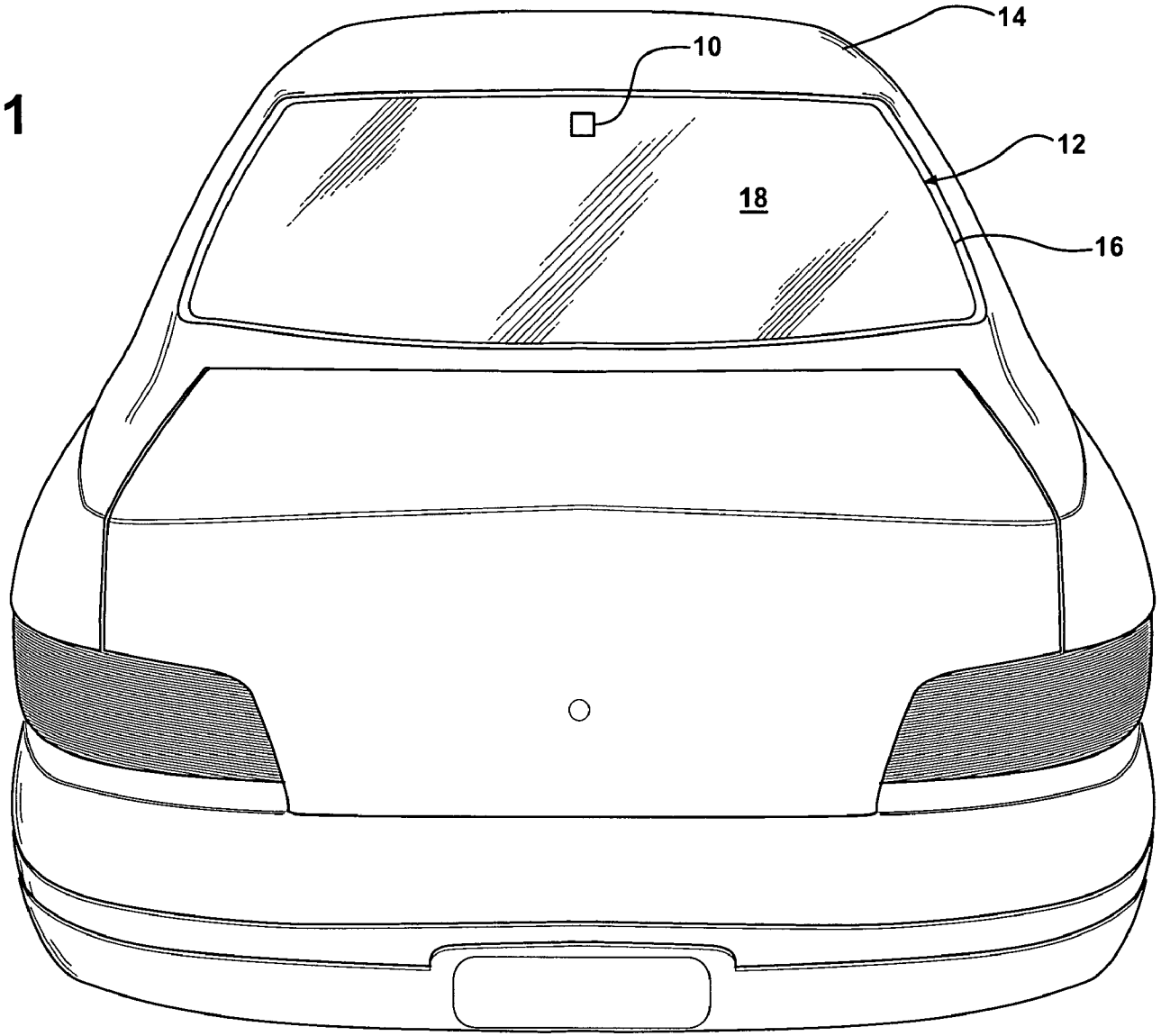
FIG. 1 is a perspective view of a vehicle with an antenna supported by a pane of glass of the vehicle.

Referring to FIG. 1, the antenna 10 is preferably integrated with a window 12 of a vehicle 14. This window 12 may be a rear window 12 (backlite), a front window 12 (windshield), or any other window 12 of the vehicle 14. The antenna 10 may also be implemented in other situations completely separate from the vehicle 14, such as on a building or integrated with a radio receiver (not shown). The window 12 of the preferred embodiment includes at least one nonconductive pane 16. The term "nonconductive" refers to a material, such as an insulator or dielectric, that when placed between conductors at different potentials, permits only a small or negligible current in phase with the applied voltage to flow through the material. Typically, nonconductive materials have conductivities on the order of nanosiemens/meter.

In the preferred embodiment, the nonconductive pane 16 is implemented as at least one pane of glass 18. Of course, the window 12 may include more than one pane of glass 18. Those skilled in the art realize that automotive windows 12, particularly windshields, may include two panes of glass sandwiching a layer of polyvinyl butyral (PVB).

The pane of glass 18 is preferably automotive glass and more preferably soda-lime-silica glass. The pane of glass 18 defines a thickness between 1.5 and 5.0 mm, preferably 3.1 mm. The pane of glass 18 also has a relative permittivity between 5 and 9, preferably 7. Those skilled in the art, however, realize that the nonconductive pane 16 may be formed from plastic, fiberglass, or other suitable nonconductive materials.

Figure 2:
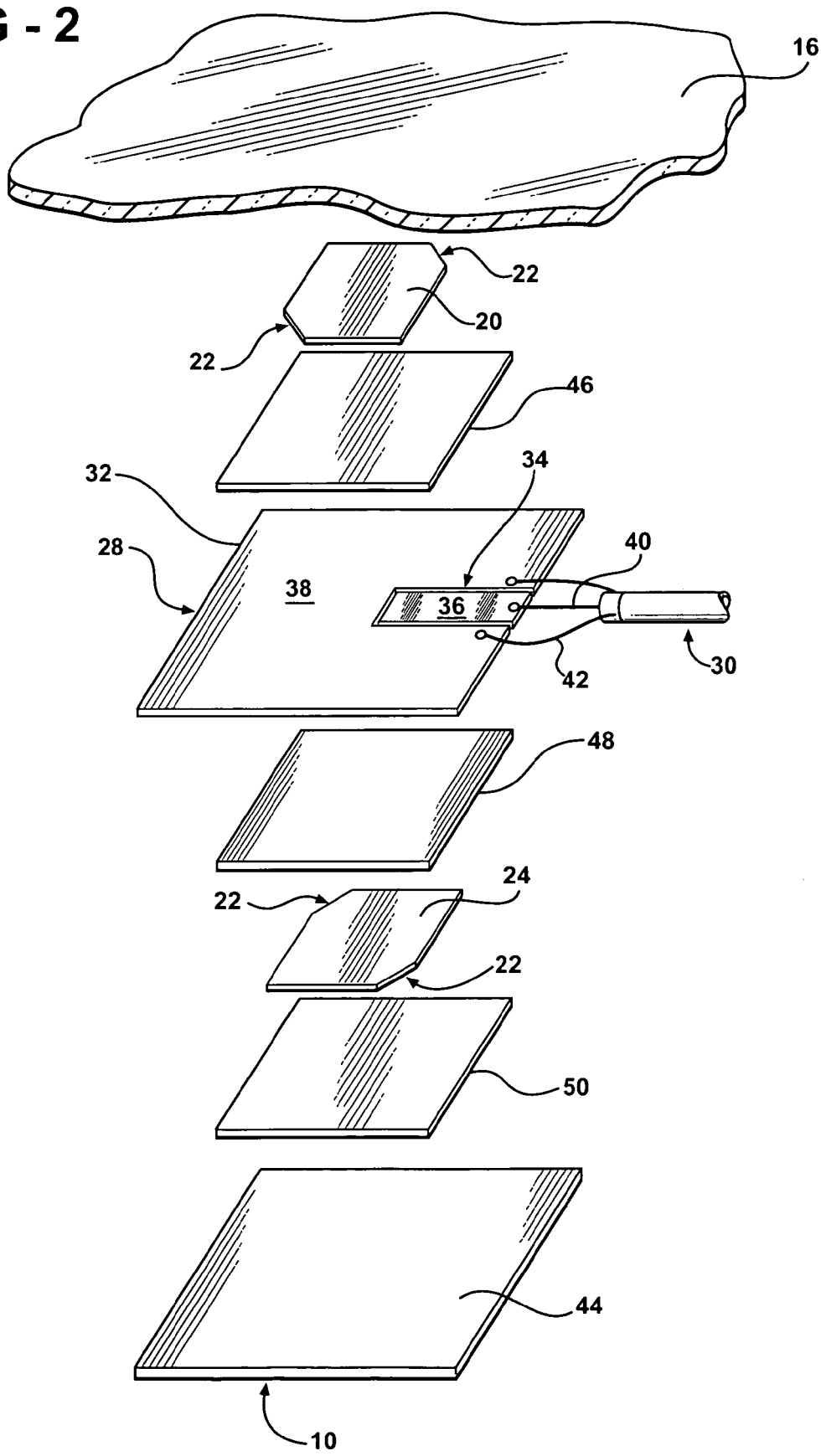
FIG. 2 is an exploded perspective view of a preferred embodiment of the antenna.
Figure 3:
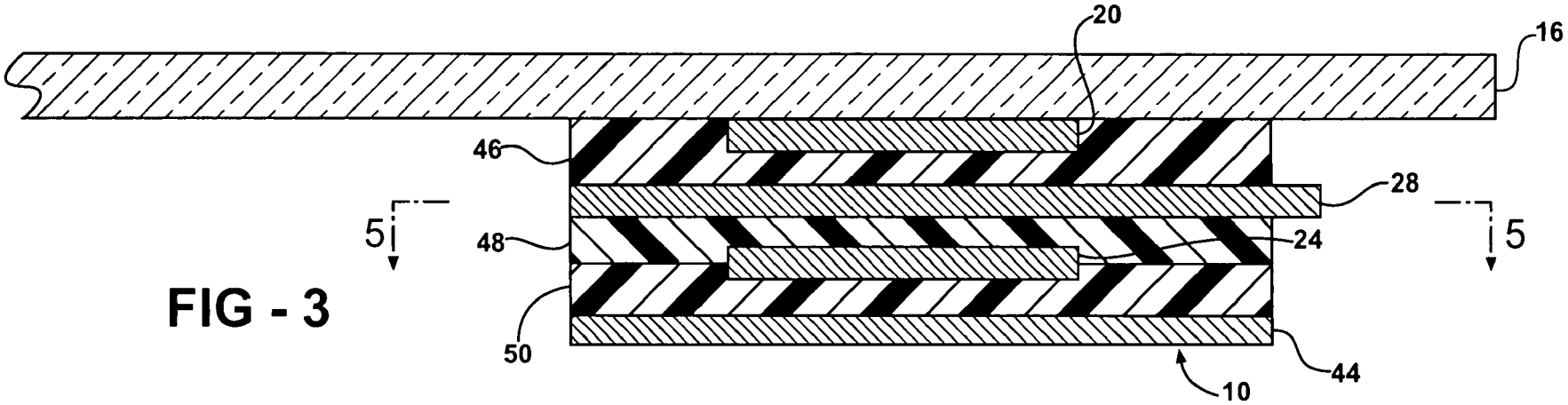
FIG. 3 is a cross-sectional side view of the preferred embodiment of the antenna.

Referring now to FIGS. 2 and 3, the nonconductive pane 16 functions as a radome to the antenna 10. That is, the nonconductive pane 16 protects the other components of the antenna 10, as described in detail below, from moisture, wind, dust, etc. that are present outside the vehicle 14.

The antenna 10 includes a first radiating layer 20 defining at least one perturbation feature 22. In the preferred embodiment, the first radiating layer 20 is disposed on the nonconductive pane 16. The first radiating layer 20 is also commonly referred to by those skilled in the art as a "patch" or a "patch element". The first radiating layer 20 is formed of an electrically conductive material. Preferably, the first radiating element comprises a silver paste as the electrically conductive material disposed directly on the nonconductive pane 16 and hardened by a firing technique known to those skilled in the art. Alternatively, the first radiating layer 20 could comprise a flat piece of metal, such as copper or aluminum, adhered to the nonconductive pane 16 using an adhesive.

The antenna 10 also includes a second radiating layer 24 also defining at least one perturbation feature 22. The second radiating layer 24 is disposed substantially parallel to and apart from the first radiating layer 20. Like the first radiating layer 20, the second radiating layer 24 is also commonly referred to by those skilled in the art as a "patch" or a "patch element" and is formed of an electrically conductive material.

The first and second radiating layers 20, 24 each include a periphery and a center. The periphery of the first and second radiating layers 20, 24 may define one of many shapes. For example, the first and second radiating layers 20, 24 may define circular shapes, as shown in FIGS. 4A, 4B, 4C, 4D, 4I, and 4J. Alternatively, referring to FIGS. 4E, 4F, 4G, 4H, 4K, and 4L, the first and second radiating layers 20, 24 may define rectangular shapes, or more specifically, square shapes. Those skilled in the art appreciate other shapes may be defined by the first and second radiating layers 20, 24. Furthermore, the first radiating layer 20 may have a different shape than the second radiating layer 24. For example, the first radiating layer 20 may have a circular shape, such as that shown in FIG. 4J, and the second radiating layer 24 may have a rectangular shape, such as that shown in FIG. 4K. However, in the preferred embodiment, the first and second radiating layers 20, 24 have substantially the same shape. By having identical shapes and dimensions for the first and second radiating layers 20, 24, a mass production cost savings will result by only having to produce one size and shape for both radiating layers 20, 24.

The at least one perturbation feature 22 of each of the first and second radiating layers 20, 24 causes a "disturbance" in an electromagnetic field radiated by the radiating elements. The perturbation features 22 may be embodied in various quantities, configurations, shapes, and positions. Referring to FIG. 4L, the radiating layer may have a single perturbation feature 22. However, typically, as shown in FIGS. 4A-4K, each of the radiating layers 20, 24 defines a pair of perturbation features 22. Each perturbation feature 22 of the pair is preferably disposed opposite one other. However, each perturbation feature 22 may be disposed at locations not opposite one other. Furthermore, those skilled in the art realize that each radiating element may define more than two perturbation features 22.

Referring to FIGS. 4A, 4C, 4E, 4F, and 4G, the at least one perturbation feature 22 of one of the radiating layers 20, 24 may be implemented as a notch preferably projecting inward from the periphery towards the center. Of course, the notch need not project towards a precise center of the radiating layer, but simply inward. The at least one perturbation feature 22 of one of the radiating layers 20, 24 may also be implemented as a tab projecting outward from the periphery away from the center, as shown in FIGS. 4B, 4D, and 4H. Likewise, the tab need not project outward from a precise center of the radiating layer. Also, as shown in FIGS. 4I through 4L, the at least one perturbation feature 22 may be defined as an aperture fully bounded within the one of the radiating layers 20, 24. Those skilled in the art realize other configurations for the perturbation features 22 other than the notches, tabs, and apertures described above.

Figure 4A:
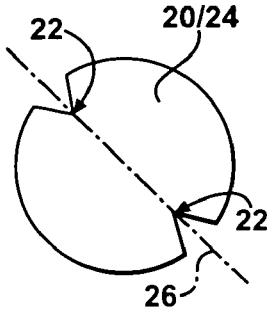
FIG. 4A is a top view of one of the radiating layers of the antenna having a circular shape with a pair of perturbation features embodied as notches having triangular shapes.
Figure 4E:
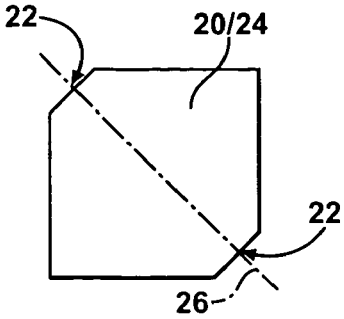
FIG. 4E is a top view of one of the radiating layers of the antenna having a rectangular shape with a pair of perturbation features embodied as truncation of opposite corners of the radiating layer.
Figure 4I:
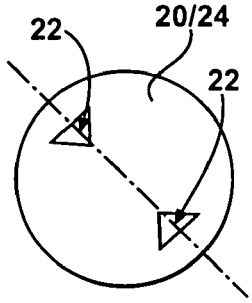
FIG. 4I is a top view of one of the radiating layers of the antenna having a circular shape with a pair of perturbation features embodied as voids having triangular shapes.
Figure 4B:
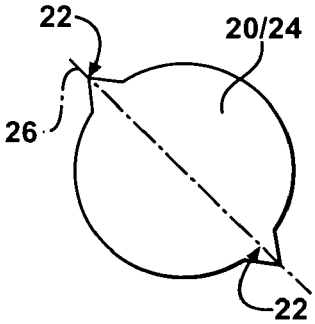
FIG. 4B is a top view of one of the radiating layers of the antenna having a circular shape with a pair of perturbation features embodied as tabs having triangular shapes.
Figure 4F:
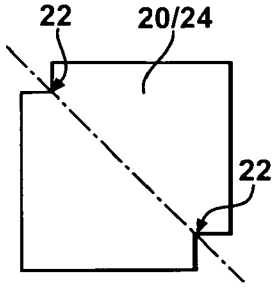
FIG. 4F is a top view of one of the radiating layers of the antenna having a rectangular shape with a pair of perturbation features embodied as notches having rectangular shapes with sides generally parallel to the sides of the radiating layer.
Figure 4J:
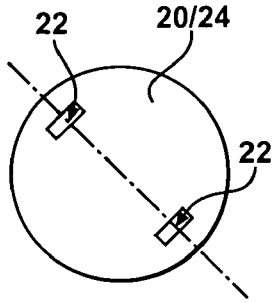
FIG. 4J is a top view of one of the radiating layers of the antenna having a circular shape with a pair of perturbation features embodied as voids having rectangular shapes.
Figure 4C:
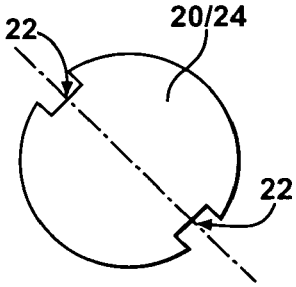
FIG. 4C is a top view of one of the radiating layers of the antenna having a circular shape with a pair of perturbation features embodied as notches having rectangular shapes.
Figure 4G:
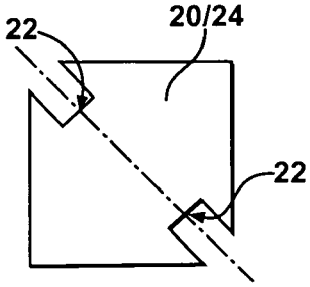
FIG. 4G is a top view of one of the radiating layers of the antenna having a rectangular shape with a pair of perturbation features embodied as notches having rectangular shapes with sides generally non-parallel to the sides of the radiating layer.
Figure 4K:
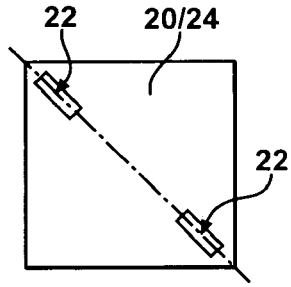
FIG. 4K is a top view of one of the radiating layers of the antenna having a rectangular shape with a pair of perturbation features embodied as voids having rectangular shapes.
Figure 4D:
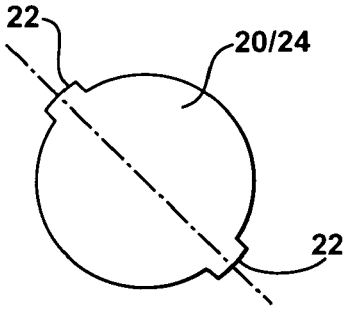
FIG. 4D is a top view of one of the radiating layers of the antenna having a circular shape with a pair of perturbation features embodied as tabs having rectangular shapes.
Figure 4H:
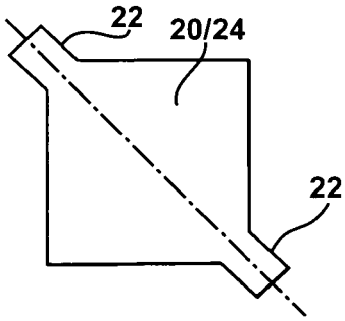
FIG. 4H is a top view of one of the radiating layers of the antenna having a rectangular shape with a pair of perturbation features embodied as tabs having rectangular shapes.
Figure 4L:
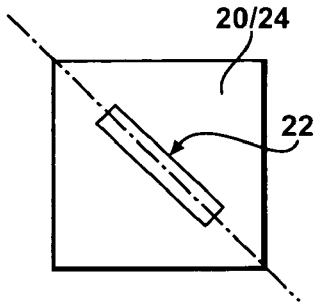
FIG. 4L is a top view of one of the radiating layers of the antenna having a rectangular shape with a perturbation feature embodied as a void having a rectangular shape.

Referring to FIGS. 4A, 4B, and 4I, the perturbation feature 22 may define a triangular shape, regardless of the configuration (notch, tab, void, or otherwise). As shown in FIGS. 4C, 4D, 4F, 4G, 4H, 4J, 4K, and 4L, the perturbation feature 22 may also define a rectangular shape. Referring to FIG. 4E, the perturbation feature 22 may be implemented as a truncation of a corner of a rectangular-shaped radiating element. Those skilled in the art realize other suitable shapes for the perturbation features 22.

The at least one perturbation feature 22 of the radiating layers 20, 24 defines at least one dimension corresponding to a desired frequency range and axial ratio of the RF signal being received and/or transmitted. Preferably, the axial ratio of the antenna 10 is about 0 dB, such that horizontal polarization and vertical polarization are about equivalent.

Referring to FIGS. 4A through 4L, an axis 26 may be defined through the center of the radiating layers 20, 24 and through a midpoint of the at least one perturbation feature 22. It is preferred that each radiating layer is generally symmetrical about this axis 26. This symmetry assists in providing the preferred axial ratio of about 0 dB. However, those skilled in the art realize that the antenna 10 may be implemented without the radiating layers 20, 24 being symmetrical about the axis 26, particularly when a different axial ratio is desired.

Referring again to FIG. 2, in the preferred embodiment, the first radiating layer 20 and the second radiating layer 24 are substantially identical to one another in configuration, shape, dimensions, disposition of perturbation features 22, etc. Most preferably, the first radiating layer 20 and the second radiating layer 24 are exactly identical to one another. However, to achieve a circular polarization with the axial ratio near 0 dB, it is preferred that the second radiating layer 24 is rotatably offset with respect to the first radiating layer 20 by about 90 degrees.

The antenna 10 also includes a feed line layer 28 disposed substantially parallel to the radiating layers 20, 24, apart from the radiating layers 20, 24, and between the radiating layers 20, 24. The feed line layer 28 allows for connection of a single transmission line 30. Thus, the feed line layer 28 electromagnetically connecting both radiating layers 20, 24 to the transmission line 30 such that both radiating layers 20, 24 can be fed by the single transmission line 30. Therefore, the complexity and cost of the antenna 10 is reduced from a prior art antenna 10 requiring a pair of transmission lines 30.

Figure 5:
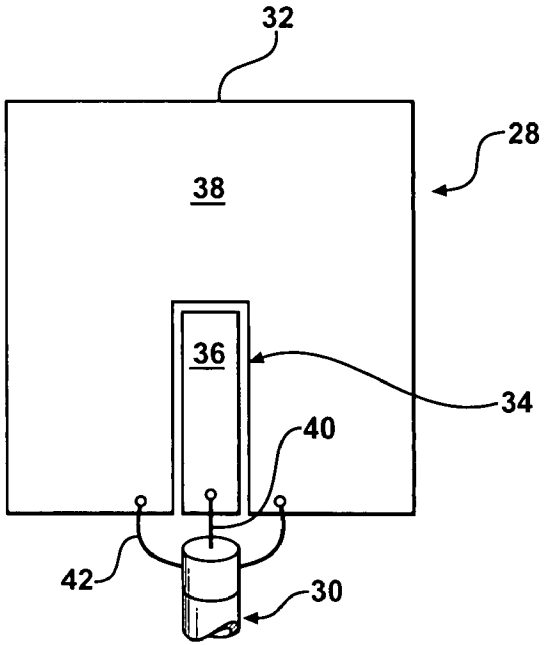
FIG. 5 is a top view of a feed line layer of the antenna taken along line 5-5 in FIG. 3 and embodied as a coplanar wave guide having a slot defined thereinto.

In the preferred embodiment, referring to FIG. 5, the feed line layer 28 is implemented as a coplanar wave guide 32. The coplanar wave guide 32 defines a slot 34 extending thereinto which divides the feed line layer 28 into a first region 36 and a second region 38. The transmission line 30 is preferably a coaxial cable having a center conductor 40 and an outer shield 42. The center conductor 40 is electrically connected to the first region 36 and the shield conductor is electrically connected to the second region 38.

The coplanar wave guide 32 is preferably rectangular shaped and most preferably square shaped. The first region 36 is preferably rectangular shaped having a proximate end and a distal end. The distal end of the first region 36 is preferably disposed above/below a center of the first and second radiating layers 20, 24. Of course, those skilled in the art realize other suitable shapes and dimensions for the coplanar wave guide 32. Furthermore, the shapes and dimensions of the coplanar wave guide 32 may be adjusted to tune the antenna 10 for optimizing impedance matching and other performance characteristics.

In the preferred embodiment, the antenna 10 includes a ground plane layer 44. The ground plane layer 44 is disposed substantially parallel to the radiating layers 20, 24 and separated from the first radiating layer 20 and the feed line layer 28 by the second radiating layer 24. Said another way, the ground plane layer 44 is disposed underneath the radiating layers 20, 24 and furthest away from the nonconductive pane 16. The ground plane layer 44 assists in directing the RF signal towards the radiating element (when receiving) or away from the radiating elements (when transmitting).

Referring again to FIGS. 2 and 3, in the preferred embodiment, the antenna 10 includes a first dielectric layer 46 sandwiched between the first radiating layer 20 and the feed line layer 28. A second dielectric layer 48 is preferably sandwiched between the feed line layer 28 and the second radiating layer 24. Also, preferably, a third dielectric layer 50 is sandwiched between the second radiating layer 24 and the ground plane layer 44.

The dielectric layers 46, 48, 50 are formed of nonconductive materials and isolate the radiating layers 20, 24, feed line layer 28, and ground plane layer 44 from each other. Therefore, the radiating layers 20, 24, feed line layer 28, and ground plane layer 44 are not electrically connected to one another by an electrically conductive material. Those skilled in the art realize that the dielectric layers 46, 48, 50 could be formed of a non-conductive fluid, such as air.

The dielectric layers 46, 48, 50 may each have the same relative permittivity. Additionally, the three dielectric layers 46, 48, 50 may be formed of a single piece of dielectric material having a uniform relative permittivity. Alternatively, each of the dielectric layers 46, 48, 50 may have different relative permittivities. Furthermore, each dielectric layer may be non-uniform, i.e., having a different relative permittivity at different points along the dielectric layer.

In the preferred embodiment, the feed line layer 28 is sized and positioned such that an edge extends past edges of the first and second dielectric layers 46, 48, as shown in FIG. 3. This allow for easily accessible connection of the transmission line 30 to the feed line layer 28, without the need to route the transmission line 30 through holes in the dielectric layers 46, 48, 50.

The antenna, in one implementation of the preferred embodiment, is configured for operation at a resonant frequency of about 2,338 MHz, which corresponds to the center frequency used by XM® Satellite Radio. Those skilled in the art realize that the antenna 10 may be configured for other implementations, which correspond to different applications in different frequency ranges. For example, the antenna 10 may be configured for electronic toll collection applications in the 5.8 GHz band.

In the one implementation, each radiating layer 20, 24 is square-shaped with opposite corners truncated, as is shown in FIG. 4E. Opposite sides of each radiating layer 20, 24 are separated by about 32 to 35 mm, preferably 34 mm. However, the perturbation feature, i.e., the truncation, removes about 2 to 3 mm, preferably 2.2 mm from each side. Therefore, each side of each radiating layer 20, 24 defines a length of about 30 to 33 mm, preferably 31.8 mm, and the perturbation feature defines a length of about 3 to 4 mm, preferably 3.1 mm.

The feed line layer 28 of the one implementation of the preferred embodiment is also square-shaped with each side having a length of about 60 mm. As stated above, the feed line layer is implemented as a coplanar wave guide 32. The slot 34 extends about 30 mm into the coplanar wave guide 32 from one of the sides and has a width of about 0.2 mm. The first region 36 defines a width of about 4.5 mm. The radiating layers 20, 24 and the feed line layer 28 are centered with respect to one another, such that a distal end of the first region 36 is centered with respect to the radiating layers 20, 24.

The ground plane layer 44 of the one implementation is also square-shaped with each side having a length of about 60 mm Each dielectric layer 46, 48, 50 of the one implementation has a thickness of about 1.6 mm, a loss tangent of 0.0022, and a relative permittivity of 2.6. The overall thickness of the antenna 10 measures about 4.8 mm.

The one implementation of the antenna 10 provides excellent performance at the desired resonant frequency of 2,338 MHz. The antenna 10 provides a maximum return loss of 23.7 dB at the desired resonant frequency. Furthermore, the LHCP gain of the antenna is 4.5 dBic while the RHCP gain, which is undersired, is −21.1 dBic. The axial ratio of the one implementation measures 1.36 dB at 2,338 MHz.

The antenna 10 may be integrated in an antenna module (not shown) along with other RF devices (not shown), such as an amplifier (not shown). The amplifier may be in close proximity to and/or directly connected to the feed line layer 28 of the antenna 10 to generate an amplified signal. Therefore, the amplified signal will be less susceptible to RF noise and interference than non-amplified signals, providing a less error-prone signal to the receiver.

Obviously, many modifications and variations of the present invention are possible in light of the above teachings. The invention may be practiced otherwise than as specifically described within the scope of the appended claims.

What is claimed is:

1. A window having an integrated antenna, said window comprising:

a nonconductive pane;

a first radiating layer disposed on said nonconductive pane and defining at least one perturbation feature;

a second radiating layer disposed substantially parallel to said first radiating layer, non-planar with said first radiating layer, and apart from said first radiating layer and defining at least one perturbation feature;

a feed line layer disposed substantially parallel to said radiating layers, apart from said radiating layers, and between said radiating layers for connection of a single transmission line and for electromagnetically connecting said radiating layers to the transmission line;

a first dielectric layer defining at least one side and sandwiched between said first radiating layer and said feed line layer; and a second dielectric layer defining at least one side and sandwiched between said feed line layer and said second radiating layer;

wherein said feed line layer is further defined as a coplanar wave guide defining a slot extending thereinto and dividing said feed line layer into a first region and a second region; and wherein said feed line layer extends past said sides of said dielectric layers for allowing electrical connection of a transmission line to both of said regions of said feed line layer.

2. A window as set forth in claim 1 wherein said nonconductive pane is further defined as a pane of glass.

3. A window as set forth in claim 2 wherein said pane of glass is further defined as automotive glass.

4. A window as set forth in claim 3 wherein said automotive glass is further defined as soda-lime-silica glass.

5. A window as set forth in claim 1 wherein said nonconductive pane is further defined as a radome for protecting said radiating layers and said feed line layer.

6. A window as set forth in claim 1 wherein said perturbation features each define at least one dimension corresponding to a desired frequency range and axial ratio of a radio frequency (RF) signal.

7. A window as set forth in claim 1 wherein said first radiating layer and said second radiating layer are substantially identical to one another.

8. A window as set forth in claim 7 wherein said second radiating layer is rotatably offset with respect to said first radiating layer by about 90 degrees.

9. A window as set forth in claim 1 wherein each of said radiating layers defines a pair of perturbation features.

10. A window as set forth in claim 9 wherein each of said pair of perturbation features of each radiating layer is disposed opposite one other.

11. A window as set forth in claim 1 further comprising a ground plane layer disposed substantially parallel to said radiating layers and separated from said first radiating layer and said feed line layer by said second radiating layer.

12. An antenna comprising:

a first radiating layer defining at least one perturbation feature;

a second radiating layer disposed substantially parallel to said first radiating layer, non-planar with said first radiating layer, and apart from said first radiating layer and defining at least one perturbation feature a feed line layer disposed substantially parallel to said radiating layers, apart from said radiating layers, and between said radiating layers for connection of a single transmission line and for electromagnetically connecting said radiating layers to the transmission line; and a first dielectric layer defining at least one side and sandwiched between said first radiating layer and said feed line layer; and a second dielectric layer defining at least one side and sandwiched between said feed line layer and said second radiating layer;

wherein said feed line layer is further defined as a coplanar wave guide defining a slot extending thereinto and dividing said feed line layer into a first region and a second region; and wherein said feed line layer extends past said sides of said dielectric layers for allowing electrical connection of a transmission line to both of said regions of said feed line layer.

13. An antenna as set forth in claim 12 wherein said perturbation features each define at least one dimension corresponding to a desired frequency range and axial ratio of a radio frequency (RF) signal.

14. An antenna as set forth in claim 12 wherein said first radiating layer and said second radiating layer are substantially identical to one another.

15. An antenna as set forth in claim 14 wherein said first radiating layer and said second radiating layer are identical to one another.

16. An antenna as set forth in claim 14 wherein said second radiating layer is rotatably offset with respect to said first radiating layer by about 90 degrees.

17. An antenna as set forth in claim 12 wherein each of said radiating layers defines a pair of perturbation features.

18. An antenna as set forth in claim 17 wherein each of said pair of perturbation features of each radiating layer is disposed opposite one other.

19. An antenna as set forth in claim 12 wherein said first and second radiating layers each define a circular shape.

20. An antenna as set forth in claim 12 wherein said first and second radiating layers each define a rectangular shape.

21. An antenna as set forth in claim 12 wherein one of said radiating layers includes a periphery and a center and wherein said at least one perturbation feature of said one of said radiating layers is further defined as a notch projecting inward from said periphery towards said center.

22. An antenna as set forth in claim 12 wherein one of said radiating layers includes a periphery and a center and wherein said at least one perturbation feature of said one of said radiating layers is further defined as a tab projecting outward from the periphery away from the center.

23. An antenna as set forth in claim 12 wherein said at least one perturbation feature of one of said radiating layers is further defined as an aperture fully bounded within said one of said radiating layers.

24. An antenna as set forth in claim 12 further comprising an axis defined through a center of one of said radiating layers and through a midpoint of said at least one perturbation feature of said one of said radiating layers and wherein said at least one of said radiating layer is generally symmetrical about said axis.

25. An antenna as set forth in claim 12 further comprising a ground plane layer disposed substantially parallel to said radiating layers and separated from said first radiating layer and said feed line layer by said second radiating layer.

26. An antenna as set forth in claim 25 further comprising a third dielectric layer sandwiched between said second dielectric layer and said ground plane layer.

27. An antenna as set forth in claim 26 wherein said third dielectric layer has a permittivity different from the permittivity of said first and second dielectric layers.

28. An antenna comprising:

a first radiating layer defining at least one perturbation feature;

a second radiating layer disposed substantially parallel to said first radiating layer, non-planar with said first radiating layer, and apart from said first radiating layer and defining at least one perturbation feature;

a feed line layer disposed substantially parallel to said radiating layers, apart from said radiating layers, and between said radiating layers for connection of a single transmission line and for electromagnetically connecting said radiating layers to the transmission line; and a ground plane layer disposed substantially parallel to said radiating layers and separated from said first radiating layer and said feed line layer by said second radiating layer.

29. An antenna as set forth in claim 28 further comprising a third dielectric layer sandwiched between said second dielectric layer and said ground plane layer.

30. An antenna as set forth in claim 29 wherein said third dielectric layer has a permittivity different from the permittivity of said first.

* * * * *